US008613514B2

(12) United States Patent
Ozaki

(10) Patent No.: US 8,613,514 B2
(45) Date of Patent: Dec. 24, 2013

(54) LIQUID EJECTION DEVICE

(75) Inventor: Kazuma Ozaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 145 days.

(21) Appl. No.: 13/037,767

(22) Filed: Mar. 1, 2011

(65) Prior Publication Data

US 2011/0221843 A1 Sep. 15, 2011

(30) Foreign Application Priority Data

Mar. 12, 2010 (JP) ..... 2010-055480

(51) Int. Cl.
*B41J 2/01* (2006.01)

(52) U.S. Cl.
USPC ..... 347/104; 347/101

(58) Field of Classification Search
USPC ..... 347/104, 16, 22, 30, 31, 85; 250/234; 400/648
See application file for complete search history.

(56) References Cited

U.S. PATENT DOCUMENTS

| | | | | |
|---|---|---|---|---|
| 6,070,977 | A * | 6/2000 | Nuita et al. | 347/104 |
| 2002/0031389 | A1* | 3/2002 | Wotton et al. | 400/648 |
| 2006/0274108 | A1* | 12/2006 | Shimizu | 347/22 |
| 2007/0097171 | A1* | 5/2007 | Kagami et al. | 347/31 |
| 2007/0109386 | A1* | 5/2007 | Mohri et al. | 347/104 |
| 2007/0291096 | A1 | 12/2007 | Toyoshima | |
| 2009/0179969 | A1* | 7/2009 | Hibbard et al. | 347/85 |
| 2009/0244247 | A1* | 10/2009 | Yamamoto et al. | 347/104 |
| 2009/0290008 | A1* | 11/2009 | Fukui | 347/104 |
| 2010/0118098 | A1* | 5/2010 | Ebihara | 347/104 |
| 2010/0193672 | A1* | 8/2010 | Blasenheim et al. | 250/234 |
| 2011/0074872 | A1* | 3/2011 | Ozaki et al. | 347/30 |
| 2011/0193909 | A1* | 8/2011 | Takamoto | 347/16 |
| 2012/0236059 | A1* | 9/2012 | Toya | 347/16 |

FOREIGN PATENT DOCUMENTS

| | | |
|---|---|---|
| JP | 2007-098936 A | 4/2007 |
| JP | 2008-254218 A | 10/2008 |
| JP | 2009-119778 A | 6/2009 |
| JP | 2009-126034 A | 6/2009 |

* cited by examiner

*Primary Examiner* — Manish S Shah
*Assistant Examiner* — Yaovi Ameh
(74) *Attorney, Agent, or Firm* — Global IP Counselors, LLP

(57) ABSTRACT

A liquid ejection device includes a liquid ejection unit configured to eject a liquid onto an ejection medium, and an ejection medium support unit disposed on the transport path of the ejection medium and adapted to support the ejection medium. The ejection medium support unit has a suction opening for retaining the ejection medium through suctional attraction by applying suction on a back face of the ejection medium. A rim of the suction opening has a contour rising above a surrounding area of the suction opening.

3 Claims, 5 Drawing Sheets

LIQUID EJECTION DEVICE

CROSS-REFERENCE TO RELATED APPLICATIONS

This application claims priority to Japanese Patent Application No. 2010-055480 filed on Mar. 12, 2010. The entire disclosure of Japanese Patent Application No. 2010-055480 is hereby incorporated herein by reference.

BACKGROUND

1. Technical Field

The present invention relates to a liquid ejection device for ejecting a liquid onto an ejection medium, and relates in particular to a liquid ejection device having a suction opening for retention on ejection medium supporting means adapted to support the ejection medium, through suctional attraction of the ejection medium through suction power acting on the back face of the ejection medium.

2. Related Art

An example of a recording device, in particular an inkjet printer, is described hereinbelow as one example of a liquid ejection device. In the field of inkjet printers, there exist inkjet printers like those disclosed in Japanese Laid-Open Patent Application 2007-98936 and Japanese Laid-Open Patent Application 2008-254218 below, furnished with ejection medium supporting means (hereinbelow also referred to as a "paper support portion") adapted to support the paper delivered to a liquid ejection area and having suction grooves for retention through suctional attraction of an ejection medium (hereinbelow also referred to as "paper") through air suction in order to stabilize orientation of the paper during printing.

A suction opening is disposed at the bottom of the suction groove, and the paper is retained through suctional attraction by suction power from the suction opening and negative pressure arising due to obstruction of the upper face of the suction groove by the paper that has been delivered to the upper portion of the suction groove.

Among inkjet printers, there are so-called borderless printing-compatible inkjet printers which are able to record over the entire recording face of the paper. Inkjet printers of this kind are provided with an ink receptacle (recessed portion) at a location corresponding to the standard size of the paper, for collecting oversprayed ink during borderless printing (Japanese Laid-Open Patent Application 2008-254218).

With regard to this ink receptacle, in Japanese Laid-Open Patent Application 2008-254218, for example, an aperture for recovery purposes is formed in the bottom of the ink receptacle, and the aperture is connected to a suction source via a communicating passage. Ink oversprayed into the ink receptacle is drained by the action of the negative pressure suction force of the suction source, and is directed into a waste ink collection portion. Moreover, due to the action of the negative pressure suction force on the ink receptacle, the paper that has been fed over the ink receptacle is retained through suctional attraction by the negative pressure.

SUMMARY

However, there was a risk that the suction opening provided at the bottom of the suction groove would suck in the ink mist produced during borderless printing or the ink per se (i.e., ink drops of greater size than ink mist), and discharge this ink to the outside of the device together with the exhaust draft of the suction fan, potentially soiling the area around the device.

Also, if ink accumulates at the bottom of the suction groove, there was a risk that the ink would collect to the point that a large mass of ink is sucked into the interior from the rim of the suction opening due to suctional action, as a result possibly soiling the interior of the paper support portion, or being discharged to the outside of the device together with the exhaust draft of the suction fan and soiling the area around the device, as described above.

With the foregoing in view, it is an object of the present invention to reduce or prevent ink or ink mist from being directly or indirectly sucked into suction openings.

To attain the above object, a liquid ejection device according to a first aspect of the present invention includes a liquid ejection unit and an ejection medium support unit. The liquid ejection unit is configured to eject a liquid onto an ejection medium. The ejection medium support unit is disposed on a transport path of the ejection medium and configured to support the ejection medium, the ejection medium support unit having a suction opening for retaining the ejection medium through suctional attraction by applying suction on a back face of the ejection medium, a rim of the suction opening having a contour rising above a surrounding area of the suction opening.

According to the present aspect, the suction opening formed in the ejection medium support unit which supports the ejection medium is formed such that the rim thereof has a contour which rises above the surrounding area of the suction opening, and thus even if liquid collects in the surrounding area of the suction opening, it is possible to prevent this mass of liquid from being sucked into the interior of the suction opening (damming effect).

Moreover, due to the aforementioned raised contour, the airflow produced by suction action is directed upward from the plane of the surrounding area of the suction opening, i.e., towards the back face of the ejection medium. By so doing, there may be obtained the action of directing the liquid or liquid in mist form to collide with the back face of the ejection medium and become deposited thereon prior to entering the suction opening, and preventing the liquid or liquid in mist form from being sucked into the suction opening, or reducing the extent thereof.

In the liquid ejection device as described above, the ejection medium support unit preferably has a first recessed portion for receiving liquid oversprayed into an area lying outside of edges of the ejection medium, and a second recessed portion disposed adjacent to the first recessed portion and inwardly of the first recessed portion towards an inward side of the ejection medium, and communicating with the first recessed portion. The suction opening is preferably disposed in the second recessed portion.

According to the present aspect, the suction opening is disposed in a second recessed portion at a location adjacent to the first recessed portion which receives liquid oversprayed into an area lying outside the edges of the ejection medium, whereby the raised contour of the suction opening may be situated at a location where misting of the liquid is prone to occur, and the working effect of the first aspect described earlier may be effectively attained.

In the liquid ejection device as described above, the rim of the suction opening preferably rises with a sloped profile in a direction from an outside towards an inside of the suction opening.

According to the present aspect, the rim of the suction opening rises with a sloped profile from the outside (the surrounding area) towards the inside, and therefore the aforementioned airflow produced by suction action, i.e., the airflow directed from the plane of the surrounding area of the suction opening towards the back face of the ejection medium, may be better controlled. It is accordingly possible to more dependably obtain the action of directing the liquid or liquid in mist form to collide with the back face of the ejection medium and become deposited thereon prior to entering the suction opening, and to prevent the liquid or liquid in mist form from being sucked into the suction opening, or reducing the extent thereof.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of the present invention is described below with reference to the accompanying drawings.

Figure 1:
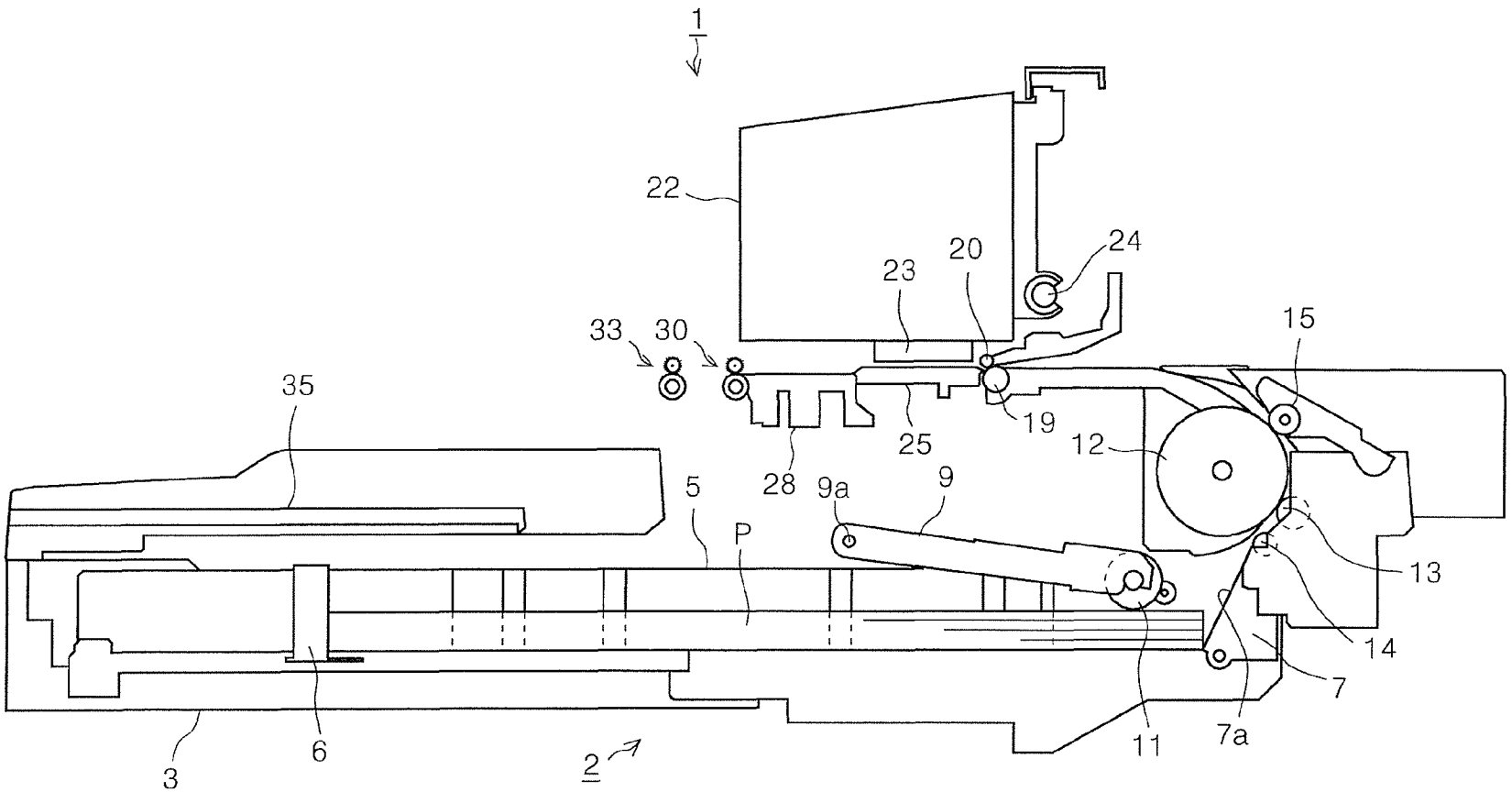
FIG. 1 is a simplified sectional side view of an inkjet printer according to the invention.
Figure 2:
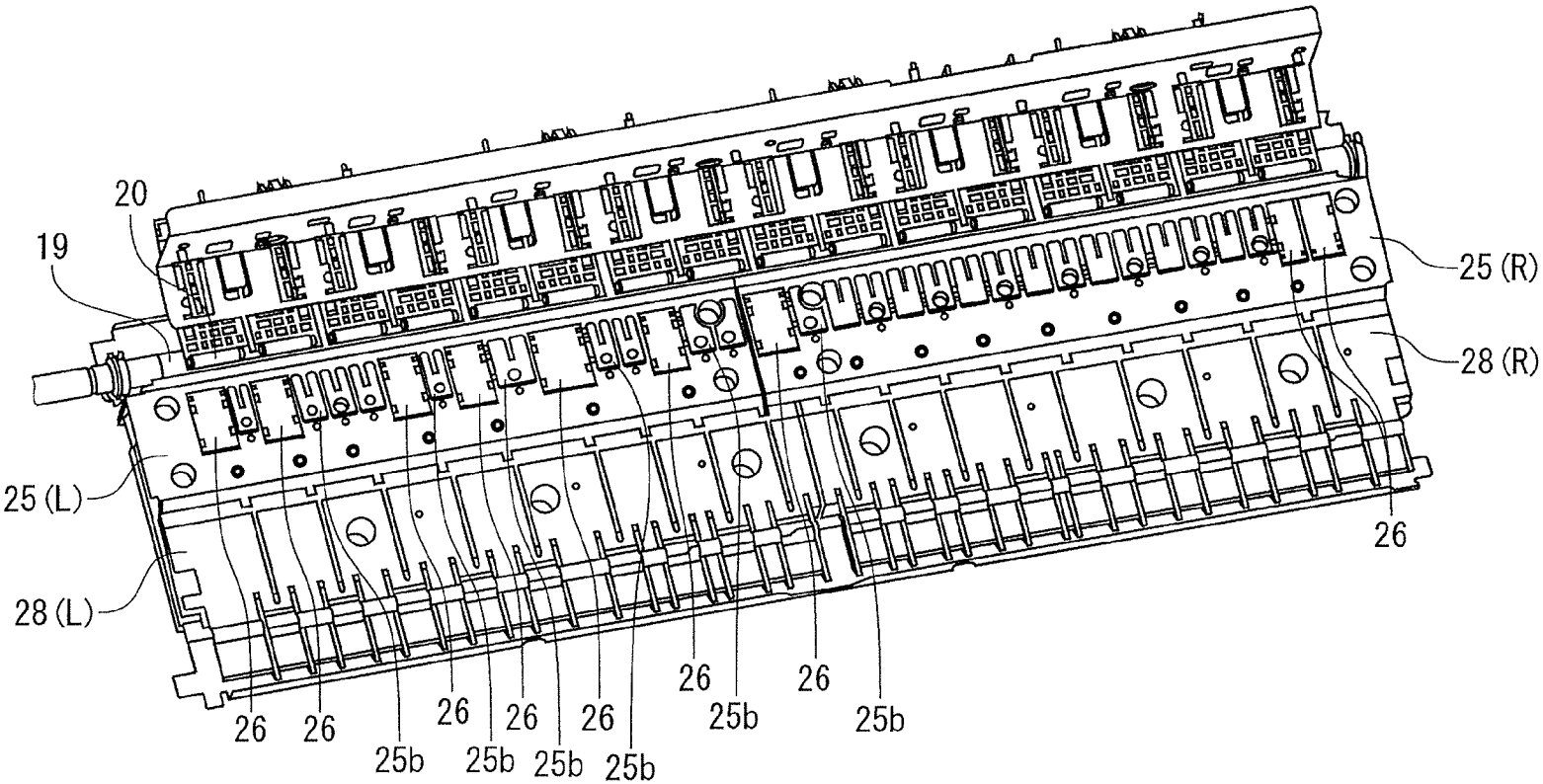
FIG. 2 is a perspective view of the vicinity of a first medium support member of an inkjet printer according to the invention.
Figure 3:
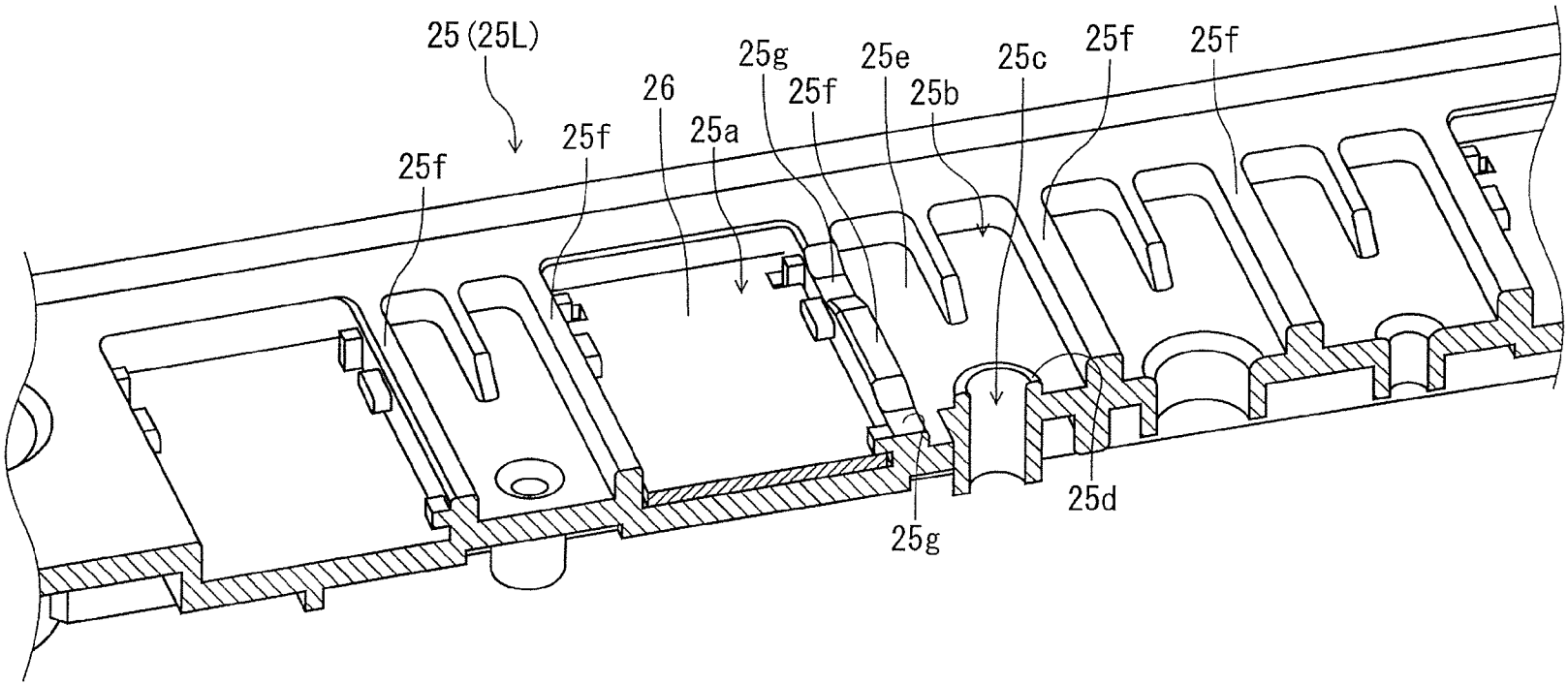
FIG. 3 is a cutaway perspective view of a first medium support member of an inkjet printer according to the invention.
Figure 4:
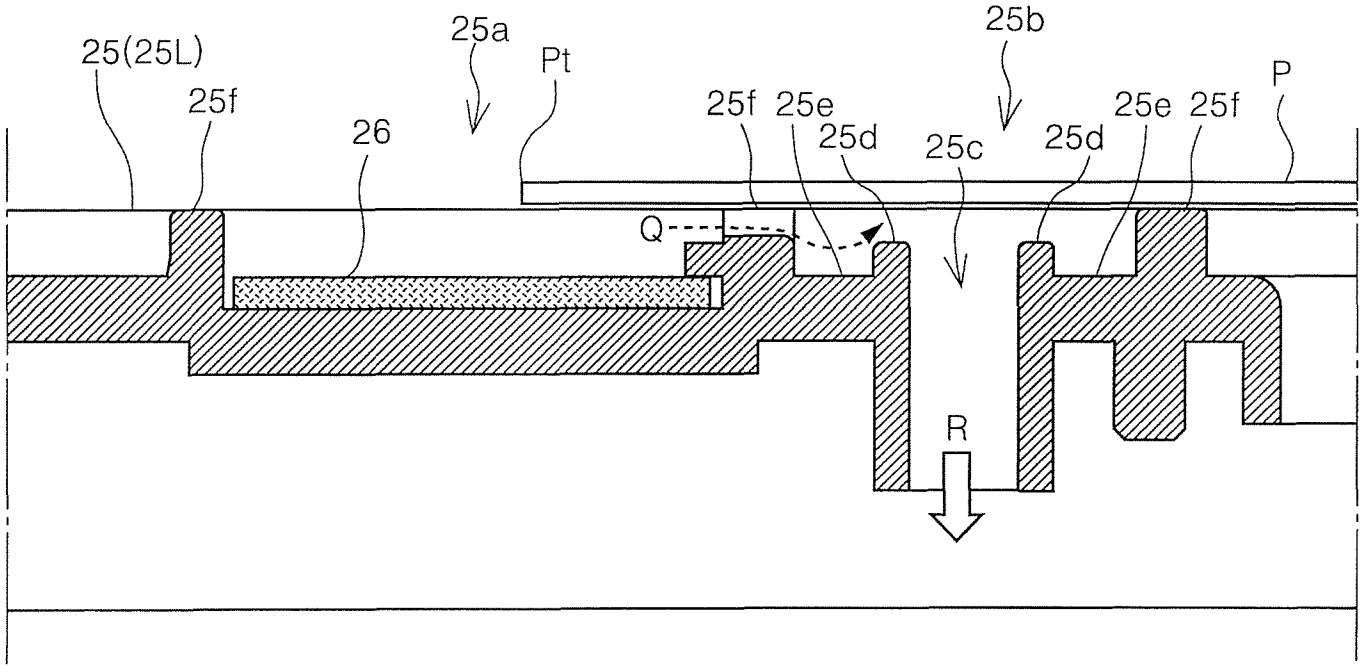
FIG. 4 is a cross-sectional view of the vicinity of a suction opening in a first medium support member.
Figure 5:
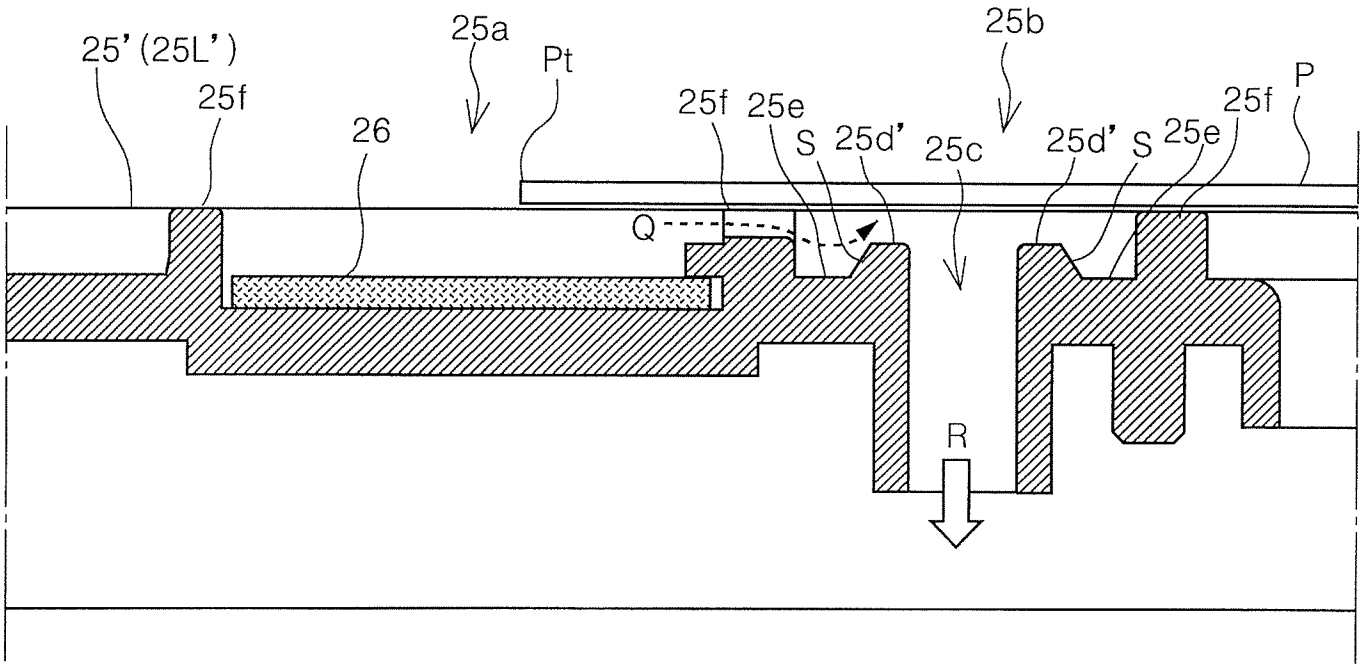
FIG. 5 is a cross-sectional view of the vicinity of a suction opening in a first medium support member according to another embodiment.

FIG. 1 is a simplified sectional side view of the paper transport path of an inkjet printer 1 described as one embodiment of the liquid ejection device or recording device according to the invention; FIG. 2 is perspective view of the vicinity of a first medium support member 25; FIG. 3 is a cutaway perspective view the first medium support member 25 (25L); and FIG. 4 is a cross-sectional view of the vicinity of a suction opening 25*c* in the first medium support member 25 (25L). FIG. 5 is a cross-sectional view of the vicinity of a suction opening 25*c* in a first medium support member 25' according to another embodiment.

The general configuration of the inkjet printer 1 is described below. The inkjet printer 1 has a paper feeder device 2 provided in the bottom of the device. As one example of an ejection medium or recorded medium, recording paper P is fed from a paper cassette 3 provided to the paper feeder device 2 and curves back around a middle roller 12 towards an inkjet recording head 23 where recording takes place. While not shown in FIG. 1, a paper roll holder is disposed to the back of the device, and recording is also possible on the roll of paper unreeled from this paper roll holder.

The constitutional elements on the paper transport path are now discussed in greater detail. The paper feeder device 2 includes the paper cassette 3, a pickup roller 11, the middle roller 12, a retard roller 13, and guide rollers 14, 15.

The paper cassette 3, which is detachably installed in the chassis of the printer device, is provided with edge guides 5, 6, and the side edges of the paper P are guided by the edge guides 5 which are situated to either side of the paper in relation to the direction of paper advance (the edge guide on the other side is not shown in the drawing). The edge guide 6 is an edge guide for guiding the back edge of the paper, and is slidably disposed in the direction of paper advance.

A separating member 7 having a sloping separation face 7*a* is disposed at a location facing towards the leading edge of the paper P held in the paper cassette 3, and the leading edge of the paper P advanced by the pickup roller 11 is fed towards the downstream end while in sliding contact against the sloping separation face 7*a*, thereby effecting preliminary separation of the topmost sheet of paper P to be fed from the next sheets of paper P which are to be fed in succession thereafter.

The pickup roller 11 is pivotally supported on a rocking member 9 that is rockable in the clockwise direction and counterclockwise direction in FIG. 1 about a rocking shaft 9*a*, and is designed to be rotary driven by power from a drive motor (not shown). During paper feed the pickup roller 11 rotates in contact with the topmost sheet of paper P held in the paper cassette 3, and thereby discharges the topmost sheet of the paper P from the paper cassette 3.

The paper P discharged from the paper cassette 3 now enters a curve back zone. The following rollers are disposed in this curve back zone: the middle roller 12, the retard roller 13, and the guide rollers 14, 15.

The middle roller 12 is a large-diameter roller that defines the inward side of a curve back path along which the paper curves and reverses direction, and is rotary driven by a drive motor (not shown). Through rotation in the counterclockwise direction in FIG. 1, the paper P is fed towards the downstream end while curling around the roller.

The retard roller 13 is releasably urged into contact against the middle roller 12 in a condition imparted with a prescribed level of rotational frictional force, and is adapted to nip the paper between itself and the middle roller 12, thereby separating the topmost sheet of paper P to be fed from the next sheets of paper P to be fed in succession thereafter.

The guide rollers 14, 15 are freely rotatable rollers; of these, the guide roller 15 nips the paper P between itself and the middle roller 12, thereby assisting paper advance by the middle roller 12.

Next, a driven transport roller 19 and a follower transport roller 20 are disposed to the downstream side of the middle roller 12. The driven transport roller 19 is rotary driven by a drive motor (not shown), while the follower transport roller 20 nips the paper between itself and the driven transport roller 19, and experiences following rotation in association with feed of the paper.

To the downstream end of the driven transport roller 19, the inkjet recording head 23 which constitutes the liquid ejection unit or recording means is disposed facing the paper feed path. The inkjet recording head 23 is disposed on the bottom of a carriage 22, and this carriage 22 is designed to undergo reciprocating movement in a main scanning direction (towards front and back of the plane of the page in FIG. 1) when supplied with power by a drive motor (not shown). Drawing symbol 24 denotes a guide shaft for guiding the carriage 22 along the main scanning direction.

A first medium support member 25 constituting the ejection medium support unit and adapted to support the recording paper P is provided at a location facing the inkjet recording head 23 on the paper feed path, and a second medium support member 28 is disposed to the downstream side thereof. By supporting the recording paper P on these support members, a gap is defined between the recording face and the inkjet recording head 23.

The inkjet printer 1 is a large format printer capable of recording large paper formats up to a maximum size of A2, for example; owing to the large size of the device, the first medium support member 25 is composed of two members (25R, 25L) situated along the paper width direction. Likewise, the second medium support member 28 is composed of two members (28R, 28L) situated along the paper width direction.

The reference position of the paper width direction during feed of the recording paper P is the right side in FIG. 2, and a greater number of ink absorbing materials 26 (ink overspray grooves 25*a*) are provided to first medium support member 25L disposed on the left side in FIG. 2, than to the first medium support member 25R disposed on the right side. The ink absorbing materials 26 and the ink overspray grooves 25*a* will be discussed in detail later.

Next, first medium ejection means 30 and second medium ejection means 33 composed of a pair of rollers are disposed to the downstream side of the second medium support member 28, and the recording paper P having undergone recording is ejected towards a paper eject stacker 35 by these medium ejection means. The paper eject stacker 35 is extendable and retractable, and is shown in the retracted state in FIG. 1.

The preceding describes the general configuration of the inkjet printer 1; following is a detailed discussion of the first medium support member 25 with reference to FIGS. 3 to 5. As noted above, the first medium support member 25 is composed of the first medium support member 25L and the first medium support member 25R, but because the ink overspray grooves 25*a*, etc., formed in each of these are the same between left and right, the first medium support member 25 (25L) on the left side in FIG. 2 is described hereinbelow by way of example.

The ink overspray grooves 25*a* provided as the "first recessed portions" are formed along the paper width direction on the upper face of the first medium support member 25. The ink overspray grooves 25*a* are recesses for receiving ink that has been oversprayed into the area outside the paper edge Pt during borderless printing of the edge Pt of the recording paper (shown in FIG. 4: in the present embodiment, an edge in the paper width direction), and are situated at locations corresponding to the edge Pt of recording paper P of the size that it is assumed in advance will be used.

Accordingly, a plurality of ink overspray grooves 25*a* are formed along the paper width direction on the upper face of the first medium support member 25. An ink absorbing materials 26 for absorbing ink are disposed on the bottom faces of the ink overspray grooves 25*a*. A waste liquid tank (not shown) is disposed below the first medium support member 25, and ink that is oversprayed into the ink overspray grooves 25*a* drains out to the waste liquid tank through drain openings (not shown) formed in the bottom faces of the ink overspray grooves 25*a*.

Next, recessed portions (suction grooves) 25*b* provided as the "second recessed portions" are formed at locations adjacent to and biased towards the inward side of the paper (the right side in FIGS. 2 and 3) from the ink overspray grooves 25*a*. Suction openings 25*c* are formed in the bottom faces 25*e* of these recessed portions 25*b*. The suction openings 25*c* connect to a fan unit (not shown), and through operation of the fan unit, suction power is caused to act on the back face of the recording paper P, and the recording paper P is retained through suctional attraction thereby. Besides the recessed portions 25*b* adjacent to and biased towards the inward side of the paper from the ink overspray grooves 25*a*, additional recessed portions may be formed as appropriate so as to provide uniform suctional attraction of the paper across the paper width direction.

Next, paper support portions 25*f* lie between the ink overspray grooves 25*a* and the recessed portions 25*b* to either side. The paper support portions 25*f* support the recording paper P, and a groove 25*g* is formed in the paper support portion 25*f* between the ink overspray groove 25*a* and the recessed portion 25*b*, with the ink overspray groove 25*a* and the recessed portion 25*b* communicating through this groove 25*g*.

Here, the rim 25*d* of the suction opening 25*c* is formed with a contour rising one level above the base face 25*e* constituting the surrounding area of the suction opening 25*c*. The working effects of the raised rim 25*d* of the suction opening 25*c* are described below.

Because the ink overspray groove 25*a* and the recessed portion 25*b* are formed communicating through the groove 25*g*, if both the ink overspray groove 25*a* and the recessed portion 25*b* happen to be covered by the recording paper P (in the case of large size paper), negative pressure is created not only in the recessed portion 25*b* but over the entire area of the ink overspray groove 25*a* as well, and suctionally attracts the paper, thereby more effectively affording paper suctional attracting effect.

However, there is risk of the suction opening 25*c* provided in the bottom face 25*e* of the recessed portion 25*b* sucking in the ink per se (i.e., ink drops larger than ink mist) or ink mist produced during borderless recording, and of the ink being discharged to the outside of the device together with the exhaust draft by the suction fan, potentially soiling the area around the device. There is also a risk, where ink accumulates at the bottom face 25*e* of the recessed portion 25*b*, of the ink collecting to the point that a large mass of ink becomes sucked into the suction opening 25*c*, as a result possibly soiling the interior of the device, or being discharged to the outside of the device together with the exhaust draft of the suction fan and soiling the area around the device.

However, because the rim 25*d* of the suction opening 25*c* rises above the surrounding area, even if ink collects in the surrounding area of the suction opening 25*c*, it is possible to prevent this mass of ink from readily dropping into the interior of the suction opening 25*c* (damming effect).

Moreover, due to the raised contour of the rim 25*d* of the suction opening 25*c*, the airflow produced by suction action is directed upward from the surrounding area of the suction opening 25*c*, i.e., towards the back face of the recording paper P, as shown by arrow Q in FIG. 4. By so doing, there may be obtained the action of directing the ink or ink mist to collide with the back face of the recording paper P and become deposited thereon prior to entering the suction opening 25*c*, and preventing the ink or ink mist from being sucked into the suction opening 25*c*, or reducing the extent thereof.

The contour of the rim 25*d* may be modified in various ways. For example, like the rim 25*d*' of the first medium support member 25' (25L') depicted in FIG. 6, the contour may rise in a sloped profile (the section indicated by the symbol S) from the surrounding area towards the inside of the suction opening 25*c*.

By forming the contour in this way, the airflow produced by suction action, i.e., the airflow directed from the surrounding area of the suction opening 25*c* towards the back face of the recording paper P, may be better controlled. It is accordingly possible to more effectively prevent the ink or ink mist from being sucked into the suction opening 25*c*, or reduce the extent thereof.

While the present embodiment has described as the inkjet printer 1 an example of a liquid ejection device of serial type, i.e., a liquid ejection device in which recording takes place while the inkjet recording head 23 moves in the paper width direction, no limitation thereto is imposed, and implementation in an liquid ejection device of so-called line head type in which the recording head is fixedly disposed is possible as well.

Herein, the liquid ejection device is not limited to recording devices such as printers, copiers, facsimile machines, and the like which utilize an inkjet type recording head and carry out recording through ejection of ink from the recording head onto a recorded material (fed material); rather, the term is used in a sense to include devices that, in place of ink, eject a liquid corresponding to a particular application onto an ejection material (fed material) equivalent to the recorded material from a liquid ejection head equivalent to the aforementioned recording head in order to deposit the liquid onto the ejection material.

Besides the recording head mentioned above, examples of liquid ejection heads include coloring matter ejecting heads used in the manufacture of color filters for liquid crystal displays or the like; electrode material (conductive paste) ejecting heads used for forming electrodes in organic EL displays, field emission displays (FED), and the like; bioorganic compound ejecting heads used in the manufacture of biochips; specimen ejecting heads for precision pipettes, and so on.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a liquid ejection unit configured to eject a liquid onto an ejection medium; and an ejection medium support unit disposed on a transport path of the ejection medium and configured to support the ejection medium, the ejection medium support unit having a recessed portion including a bottom face, a suction opening for retaining the ejection medium through suctional attraction by applying suction on a back face of the ejection medium, the suction opening being disposed in the bottom face of the recessed portion, and a rim surrounding the suction opening and having a contour rising above the bottom face of the recessed portion with the rim being disposed between the suction opening and the bottom face of the recessed portion.

2. The liquid ejection device according to claim 1, wherein the ejection medium support unit has an additional recessed portion for receiving liquid oversprayed into an area lying outside of edges of the ejection medium, and the recessed portion is disposed adjacent to the additional recessed portion and inwardly of the additional recessed portion towards an inward side of the ejection medium, and communicates with the additional recessed portion.

3. The liquid ejection device according to claim 1, wherein the rim surrounding the suction opening rises with a sloped profile in a direction from an outside towards an inside of the suction opening.

* * * * *